United States Patent [19]

Pehr

[11] 4,159,542

[45] Jul. 3, 1979

[54] TIE HOLDER

[76] Inventor: Harold T. Pehr, 3920 W. 96th St., Overland Park, Kans. 66207

[21] Appl. No.: 882,620

[22] Filed: Feb. 28, 1978

[51] Int. Cl.[2] ..... A41D 25/08

[52] U.S. Cl. ..... 2/152 R

[58] Field of Search ..... 2/152 R, 153, 154, 152 A, 2/150, 149; 24/49 R, 49 KC, 49 CC, 49 C, 49 P

[56] References Cited

U.S. PATENT DOCUMENTS

| | | | |
|---|---|---|---|
| 3,262,166 | 7/1966 | Kellner et al. | 2/153 |
| 3,964,105 | 6/1976 | Gideon | 2/152 |
| 4,024,585 | 5/1977 | Girdler | 2/153 |

*Primary Examiner*—Doris L. Troutman

*Attorney, Agent, or Firm*—Fishburn, Gold & Litman

[57] ABSTRACT

A tie holder for supporting a necktie adjacent to the front of a closed shirt collar comprises a shield shaped plate member having front and back surfaces and converging side edges. Grasping members extend from the back surface and comprise a tang or hook member having adjacent lug members positioned on opposite sides thereof and extending from the back surface. The hook member and the lug members cooperate to form mutually engageable members for mounting the tie holder to the shirt collar. The tie holder has receiving members for detachably connecting the tie thereto which comprise arm members extendible across the back surface of the plate member. A lug member projects outwardly from the back surface and is positioned under a lower one of the arm members to form mutual surfaces which engage the necktie therebetween. In one embodiment the necktie depends from the receiving members on the back surface and the front surface presents a medallion or applique for view. An alternately embodied tie holder has an elevated loop separating the hook from the back surface, and a second loop separated from the bottom edge of the front surface. The necktie is passed under the loops of the alternate embodiment and draped over the top edge, thereby covering the front surface and exposing the necktie to view.

8 Claims, 6 Drawing Figures

TIE HOLDER

This invention relates to tie holders for supporting neckwear, and in particular, to tie holders for fitting onto the front of a shirt collar and suspending a necktie therefrom.

Tie holders are useful to attach and suspend a necktie to a shirt collar and generally eliminate the requirement of knotting the tie, thus saving material by enabling a shorter length tie to be used. Some prior art tie holders present an outwardly facing surface to which decorative items or appliques may be connected, whereas others consist of a form on which a knot is pretied and retained tied for ease of donning. Many of these devices impart either insufficient support to the tie or are insufficiently connected to the shirt collar, thereby permitting the tie to become skewed and creating an unkempt appearance.

The present invention seeks to overcome the above difficulties, and provides a tie holder having a hook member associated with engaging lugs which securely grasp and connect the holder to a buttoned or otherwise closed shirt collar. A necktie is detachably connected to the tie holder and, in one embodiment, is mounted on a back surface of the holder, thus presenting a front surface onto which medallions or appliques are mounted and, in another embodiment, the tie is positioned to cover and conceal the front surface of the holder.

The principal objects of the present invention are: to provide a tie holder having grasping means including engagement lugs for securely yet detachably connecting the holder to a closed shirt collar; to provide such a tie holder having receiving means for securely yet detachably retaining a necktie; to provide such a tie holder which is readily constructed by means such as molding; to provide such a tie holder having means for connecting a necktie to the back surface thereof; to provide such a tie holder having means for connecting a necktie to the front surface thereof; to provide such a tie holder presenting a front surface for positioning medallions or appliques thereon; and to provide such a tie holder which is relatively inexpensive, highly reliable in use, and well adapted for its intended purpose.

Other objects and advantages of this invention will become apparent from the following description taken in connection with the accompanying drawings wherein are set forth by way of illustration and example, certain embodiments of this invention.

Figure 1:
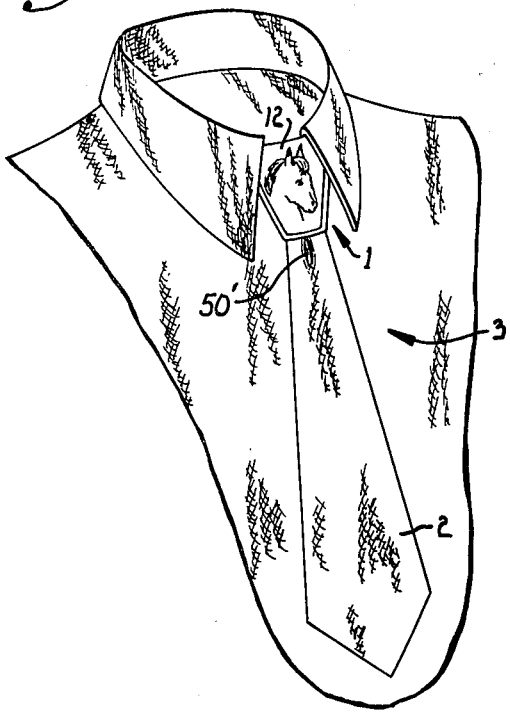
FIG. 1 is a perspective view of a tie holder embodying the present invention, and is shown in connection with a necktie supported thereby and attached to a shirt collar.

Referring to the drawings in more detail:

As required, detailed embodiments of the present invention are disclosed herein, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1, FIG. 1, generally indicates a tie holder embodying this invention. The tie holder 1 is illustrated retaining a necktie 2 detachably connected and supported thereby and is in turn detachably connected to a closed or buttoned shirt collar 3. The tie holder 1 is designed to be formed, by well known means, such as molding, from a single blank of easily workable material such as synthetic polymeric polypropylene or vinyl resin.

Figure 2:
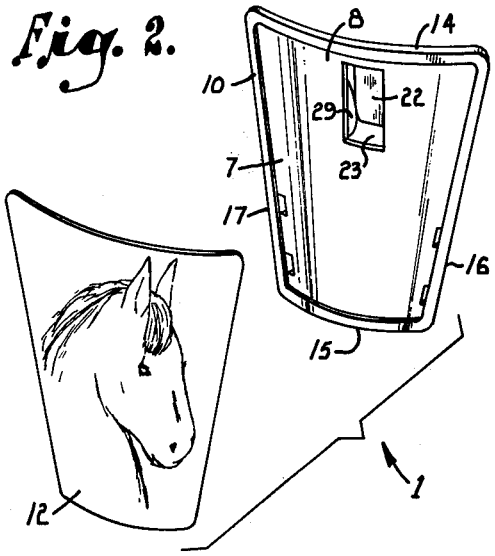
FIG. 2 is an exploded perspective view of the holder, particularly showing a front surface thereof, and an applique attached thereon.
Figure 3:
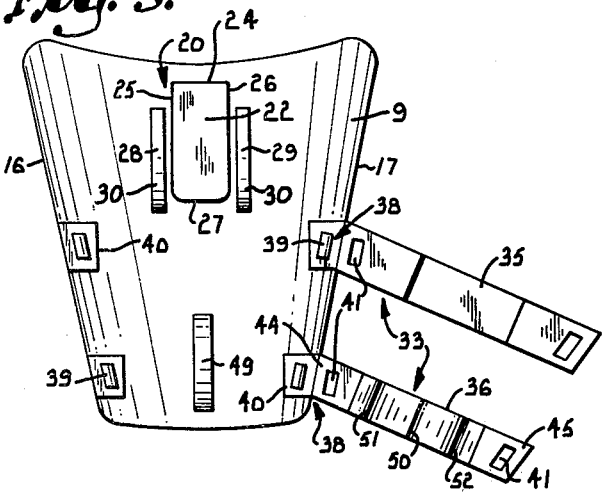
FIG. 3 is a rear plan view of the tie holder.
Figure 4:
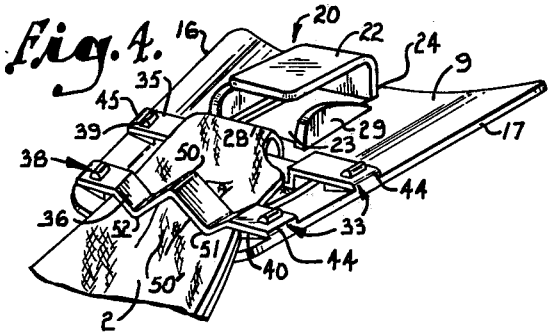
FIG. 4 is a perspective view of the tie holder showing a rear portion thereof with a necktie attached thereto.

As best illustrated in FIGS. 2 and 4, the primary structural element of the tie holder 1 is a plate member 7 formed in the general shape of a bilaterally symetrical shield having top and bottom edges 14 and 15 and downwardly converging side edges 16 and 17. The plate member 7, in this example, has a slightly convex front surface 8 and a coordinatingly concave back surface 9. In the preferred embodiment illustrated in FIGS. 1–4, the plate member 1 conceals the upper portion of the necktie 2 from view, the front surface 8 providing a face on which various decals, medallions, or appliques are mounted. To accommodate these decorative features, the front surface 8 has a raised ridge or border 10 extending around the periphery thereof. In the illustrated example, an applique 12 having a horsehead design, is affixed to the front surface 8 by suitable means such as gluing, and is positioned within the peripheral border 10.

As illustrated, the back surface 9 has grasping members 20 connected thereto for detachably connecting the plate member 7 to the shirt collar 3. In the preferred embodiment, the grasping members 20 are positioned closely to the back surface 9 and include a tang or hook member 22 extended outwardly from the top edge 14 and projecting a slight distance toward the bottom edge 15. As illustrated, in FIGS. 3 and 4, the hook member 22 has a substantially uniform transverse cross-sectional thickness and shape and functions as in the nature of a gripping clip or leaf spring. One end 24 of the hook member 22 is fixed to the plate member 7 and the remaining portion projects outwardly therefrom a predetermined distance. The hook member 22 extends longitudinally along the tie holder, and is spaced a predetermined distance from the back surface 9 for attaching the tie holder to an article of clothing. The hook member 22 has an end portion 27 with slightly rounded corners to facilitate connection with the shirt collar 3. In the illustrated embodiment, an opening 23 is disposed under the hook member 22 which is cut and bent during molding to resiliently project from the back surface 9.

The grasping members 20 also include a pair of knobs or lug members 28 and 29 positioned adjacently to the opposite side edges 25 and 26 and which extend toward the portion of the hook member 22 spaced from the back surface 9. The lug members 28 and 29 are spaced slightly outward of the side edges 25 and 26 and are oriented parallelly thereto. As illustrated, the lug members 28 and 29 are semi-elliptical or semi-teardropped in shape and have an apex 30 adjoining the lower portion of the curvedly inclined hook member 22. Together, the lug members 28 and 29 and the hook member 22 cooperate to form mutually engaging members which embrace the top of the shirt collar therebetween. In attaching the tie holder 1 to the shirt collar 3, the grasping members 20 are urged downwardly over the shirt collar 3. The lug members 28 and 29 are slid into position on the front of the collar and the upper surfaces of the lug members engaged to the shirt collar 3. The hook member 22 is resistably urged over the doubled cloth of the shirt collar 3 and springingly clamps the plate member 7 to the shirt front. When a shirt having a buttoning front is worn, the top or collar button is positioned between the separated projecting lug members 28 and 29 and springingly retained therebetween by the hook member 22, thereby providing a secure point of attachment and further preventing the tie holder from becoming skewed.

The tie holder 1 includes receiving members 33 which, in the embodiment as illustrated in FIGS. 1–4, are integrally constructed and associated with the back surface 9 for retaining and supporting a necktie 2. The receiving members 33 include a pair of upper and lower resilient arm members 35 and 36 flexibly extending transversely across the back surface 9 and connectible with fastening portions, described below, adjacent the opposite side edges 16 and 17. The arm members 35 and 36 comprise elongated strap shaped members, the ends of which include easily connectable and detachable fasteners, here shown as locking snaps 38 of conventional and well-known construction. The locking snaps 38 are positioned adjacent to the side edges 16 and 17 and are hook shaped catches or protuberances 39 extended from raised planar portions 40 of the back surface 9. The protuberances 39 are engageable with openings or passages 41 extending through the ends of the resilient arm members 35 and 36, the material of which is sufficiently flexible to admit the tip of the protuberance 39 into the passage 41 and, pressing thereon, snap over and engage.

As referred to above, the design of the tie holder 1 facilitates integral or one-piece molded construction. Accordingly, the arm members 35 and 36 are preferably molded with the plate member 7 and are integrally connected to the side edge 17 by flexibly hinged ends 44 to extend from the respective planar portions 40. The respective passages 41 are disposed from the ends 44 and 45 of the arm members 35 and 36 a slight distance inwardly to permit the flexible and resilient arm members 35 and 36 to be swung or rotated over the back surface 9 and snapped, FIGS. 3 and 4. The upper arm member 35 has straight end portions, and an inwardly bent medial portion 47 which frictionally engages the necktie 2.

The resilient lower arm member 36 has a convoluted shape which flexibly facilitates engagement of the necktie 2 thereunder. As illustrated, the lower arm member 36 is generally Vee-shaped and has an apex 50 at the longitudinal midportion thereof and portions which divergingly extend toward the back surface 9, FIG. 4. On opposite sides of the apex 50 extend curved portions 51 and 52 of the arm member 36 which are directed toward the back surface 9 and which abuttingly and resiliently engage a necktie 2 positioned thereagainst. Extending integrally from a central portion of the back surface 9 is a lug member 49 positioned to underlie the apex 50. The lug member is semi-circular in shape and has an upper surface adjoining the apex 50 to form mutually engaging members for securing the necktie 2 therebetween. When the necktie is in position the lug member 49 and the portions 51 and 52 of the lower arm member 36 cooperate to form an inwardly extending crease 50' in the necktie 2.

In the use of the embodiment, illustrated in FIGS. 1–4, the receiving members 33 engage and support a necktie 2 depending from the back of the tie holder 1. To detachably connect the necktie 2, the approximate mid-portion of the unfolded necktie 2 is laid across the back surface 9, and the upper arm member 35 is extended thereover and fastened into position by engaging the locking snaps 38 adjoining the opposite side edges 16 and 17. Next, the necktie 2 is folded over the upper arm member 35 and suspended therefrom. It is to be noted that by engaging only the one arm member 35, the necktie is supported by the tie holder 1 and partially resistably engaged by the raised portion 47 but is not securely engaged thereby and may be pulled therefrom or become skewed. To securely engage the necktie 2, the lower arm member 36 is flexibly extended across the folded necktie 2 and fastened in a manner similar to arm member 35 as described above. The apex 50 and curved portions 51 and 52 engage the cloth of the necktie 2 and press thereon, cooperating with the upper surface of the projecting lug member 49 which engages the opposite surface of the necktie 2 to form mutually engageable members which securely engage the folded cloth of the necktie 2. The arm member 36 and the lug member 49 thusly engage the necktie 2 from opposite surfaces thereof and prevent the necktie 2 from becoming skewed.

Figure 5:
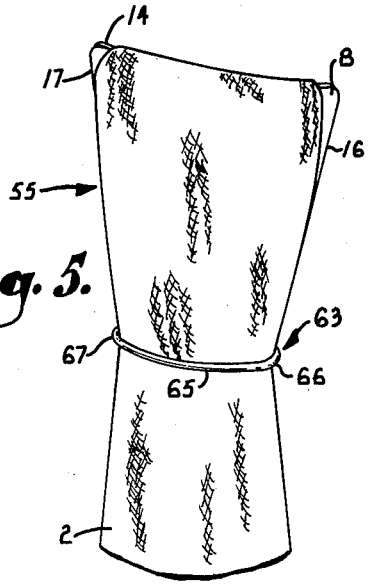
FIG. 5 is a perspective view of an alternate embodiment of the invention.
Figure 6:
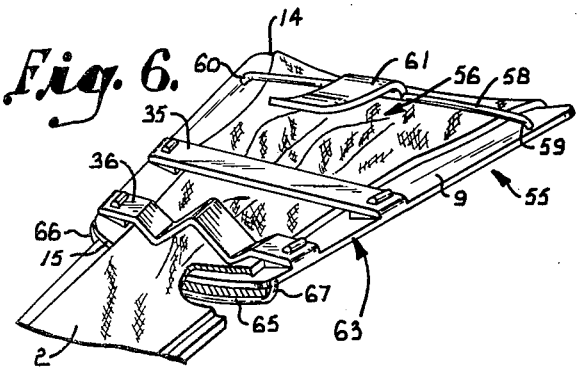
FIG. 6 is a perspective view of the tie holder shown in FIG. 5, having a portion thereof broken away to reveal internal construction.

An alternately embodied tie holder 55, also intended to be readily moldable, is illustrated in FIGS. 5 and 6 and has like parts designated by the same reference numerals employed in connection therewith in FIGS. 1–4. In the alternately embodied tie holder 55, the necktie 2 is draped over the top edge 14 of the plate member 7 and extended over the front surface 8, presenting the tie pattern for view instead of an applique, s in FIGS. 1–4.

The alternately embodied tie holder 55 employs grasping members 56 which extend beyond the back surface 9 a slight dimension to permit the necktie 2 to extend thereunder. As illustrated, a bow or loop 58 is positioned on the back surface 9 adjacent the top edge 14 and has ends 59 and 60 connected to the back surface 9 adjacent the opposite side edges 16 and 17. A tang or hook member 61, as described above in connection with the hook member 22, is connected to the mid-portion of the loop 58 and cooperates with the lug members 28 and 29 to engage the shirt collar 3.

The alternately embodied tie holder 55 employs receiving members 63 which have arm members 35 and 36 as described in connection with FIGS. 1–4 and include a front loop 65 positioned on the front surface 8 adjoining the bottom edge 15. The loop 65 extends from the front surface 8 a slight dimension to permit the necktie 2 to extend thereunder and has ends 66 and 67 connected to the front surface 8 adjoining the opposite side edges 16 and 17.

To detachably connect the necktie 2 to the alternately embodied tie holder 55, the small end of the necktie 2 is extended under the front loop 65 to overlie the front surface 8. Next, the end of the necktie 2 is draped over the top edge 14 and extended under the grasping member loop 58, over the lug members 28 and 29, and over the back surface 9. Then, the arm members 35 and 36 are snapped into place as described above to securely attach the necktie 2 to the plate member 7.

The secondly embodied tie holder 55 can be used, if desired, as described in connection with FIGS. 1–4 to suspend the necktie 2 from the back surface 9 and present the front surface 8 for view.

The necktie 2 is disengaged from the tie holder 1 by reversing the above recited steps and the necktie 2 changed for another of a different color or pattern.

It is understood that while certain forms of this invention have been illustrated and described, it is not to be limited thereto except insofar as such limitations are included in the following claims.

What is claimed and desired to secure by Letters Patent is:

1. A tie holder for supporting a necktie adjacent to the front of a closed shirt collar, said tie holder comprising:

(a) a plate member having front and back surfaces, top and bottom edges, and opposing side edges;

(b) grasping members connected with said back surface and including a resilient hook member having first and second side edges, and first and second outwardly projecting lug members positioned adjacent to the first and second hook member side edges respectively; said first and second lug members cooperating with said hook member to form mutually engageable members for detachably connecting said plate member to said closed shirt collar;

(c) receiving means connected with said plate member for engaging and supporting a necktie thereon and positioning said necktie adjacent said closed shirt collar, said receiving means including at least two movable arm members each having opposite end portions thereof detachably connected to said plate member adjacent to said side edges, and extending transversely thereacross;

(d) said movable arm opposite end portions each being connectible to said plate member by fastener means; and (e) said fastener means including a locking snap having a protuberance and an opening engageable with said protuberance.

2. A tie holder as set forth in claim 1 including:

(a) a lug member extending from said plate member back surface and positioned between said plate member and one of said arm members to form mutually engageable members for supporting said necktie therebetween.

3. A tie holder as set forth in claim 2 wherein:

(a) said first and second lug members are oriented parallel to said hook member first and second side edges and separated a sufficient dimension for receiving a button of said shirt collar therebetween.

4. A tie holder for supporting a necktie adjacent to the front of a closed shirt collar, said tie holder comprising:

(a) a plate member having front and back surfaces, top and bottom edges, and opposing side edges;

(b) grasping members connected with said back surface and including a resilient hook member having first and second side edges, and first and second outwardly projecting lug members positioned adjacent to the first and second hook member side edges respectively; said first and second lug members cooperating with said hook member to form mutually engageable members for detachably connecting said plate member to said closed shirt collar;

(c) receiving means connected with said plate member for engaging and supporting a necktie thereon and positioning said necktie adjacent said closed shirt collar;

(d) said grasping members include a first loop having said hook member connected thereto; and (e) said first loop has opposed ends connected to said back surface and extends therefrom a slight dimension for receiving and retaining said necktie thereunder.

5. A tie holder as set forth in claim 4 wherein:

(a) said receiving means include a second loop positioned on said front side adjacent said bottom edge; and (b) said second loop has opposed ends connected to said front surface and projects therefrom a slight dimension for receiving and retaining said necktie thereunder whereby said tie holder is adapted for supporting said necktie by extending said necktie under said first elevated loop, over said top edge and under said second elevated loop, thereby covering said front surface with said necktie.

6. A tie holder as set forth in claim 5 wherein:

(a) said receiving means include at least one movable arm member having opposite end portions connected to said plate member adjacent to said side edges, said arm member being positioned between said first loop and said bottom edge for engaging said necktie between said arm member and said back surface.

7. A tie holder for supporting a necktie adjacent to the front of a closed shirt collar, said tie holder comprising:

(a) a plate member having front and back surfaces, top and bottom edges, and opposing side edges;

(b) grasping members connected with said back surface and including a resilient hook member having first and second side edges, and first and second outwardly projecting lug members positioned adjacent to the first and second hook member side edges respectively; said first and second lug members cooperating with said hook member to form mutually engageable members for detachably connecting said plate member to said closed shirt collar;

(c) receiving means including at least two movable arm members having opposite end portions connected with said plate member and extending transversely thereacross for engaging and supporting a necktie thereon and positioning said necktie adjacent said closed shirt collar; and (d) locking snaps for said arm members and including a protuberance and an opening engageable with said protuberance for each arm member providing a detachable connection to the plate member for at least one end of each arm member.

8. A tie holder as set forth in claim 7 wherein:

(a) said plate member and arm members are integral and of synthetic resin with each arm member having an end portion connected to an adjacent side edge of the plate member by a flexible hinge portion.

* * * * *